United States Patent [19]

Klawitter

[11] Patent Number: 5,030,160

[45] Date of Patent: Jul. 9, 1991

[54] LIGHT DISPLAY APPARATUS

[75] Inventor: Ronald R. Klawitter, Berger, Mo.

[73] Assignee: Handi-Pac, Inc., Hermann, Mo.

[21] Appl. No.: 481,350

[22] Filed: Feb. 16, 1990

Related U.S. Application Data

[63] Continuation-in-part of Ser. No. 345,303, May 1, 1989, abandoned.

[51] Int. Cl.[5] ..... A63H 33/26

[52] U.S. Cl. ..... 446/242; 446/439; 446/484; 40/432

[58] Field of Search ..... 446/485, 242, 438, 439, 446/484; 40/432, 433, 431

[56] References Cited

U.S. PATENT DOCUMENTS

| | | | |
|---|---|---|---|
| 1,313,848 | 8/1919 | Drummond | 40/432 |
| 1,960,618 | 5/1934 | Compare | 40/432 |
| 2,055,777 | 9/1936 | Shigley | 40/432 |
| 3,325,940 | 6/1967 | Davis | 446/242 |

*Primary Examiner*—Mickey Yu

*Attorney, Agent, or Firm*—Polster, Polster and Lucchesi

[57] ABSTRACT

A light display apparatus includes a shaft with an axis, a support platform mounted for rotation about the axis, a light bracket mounted on the support for revolving about an axis offset from the shaft axis, and lamps mounted on the light bracket at a position offset from the bracket axis. The support is revolved by either mechanical gearing or directly by motor and the light bracket is revolved with respect to the support either by a mechanical gearing or linkage or by an independent motor.

16 Claims, 5 Drawing Sheets

LIGHT DISPLAY APPARATUS

RELATED U.S. APPLICATION DATA

This application is a continuation-in-part of co-pending application U.S. Ser. No. 07/345,303 filed May 1, 1989, abandoned.

BACKGROUND OF THE INVENTION

The light display apparatus of this invention is described in terms of a child's push toy, in which the mechanism is driven through the turning of a wheel, but it can take other forms.

One of the objects of this invention is to provide a simple but highly effective light display apparatus in which electrically operated lamps are rotated in such a way as to produce interesting and esthetically pleasing designs.

Other objects of this invention will be apparent to those skilled in the art in light of the following description and accompanying drawings.

SUMMARY OF THE INVENTION

In accordance with this invention, generally stated, a light display apparatus is provided that comprises a shaft with an axis, support platform means mounted for rotation about the shaft axis, light bracket means mounted on the support means for rotation about a bracket means axis, at a position offset from the shaft axis, electric light means mounted on the light bracket at a position offset from the bracket axis, means for revolving the support means, means for revolving the light bracket means with respect to the support means, and means for supplying electrical energy to the light means. In the illustrative embodiments described, the support means is revolvably mounted on the shaft, and is mechanically driven by a gear train. A shaft gear is fixedly mounted on the shaft, and a smaller diameter bracket gear is mounted on the bracket means to be driven in response to relative motion between the bracket and the shaft gear, in the embodiment shown, through an intermediate idler gear.

In one embodiment, the support means carries batteries electrically connected to lamps or L.E.D.'s through a commutator plate and wiper contacts. In a second embodiment the bracket means carries a battery which is electrically connected directly to the lamps or L.E.D.S., without the interposition of commutator and wiper contacts.

A centrifugal switch is arranged to close an electric circuit connected to a power source and to the lamps when the speed of rotation of the bracket reaches a predetermined amount.

In the embodiments described, the light display apparatus is housed in a wheeled toy in the form of a stylized bug, two wheels being secured to an axle, upon which a gear is mounted to drive the support platform means. The toy has a chassis that carries the axle and, perpendicular to it, the shaft about which the support means rotates. A transparent cover completes the bug and provides protection for the light display apparatus.

DESCRIPTION OF THE PREFERRED EMBODIMENT

Figure 4:
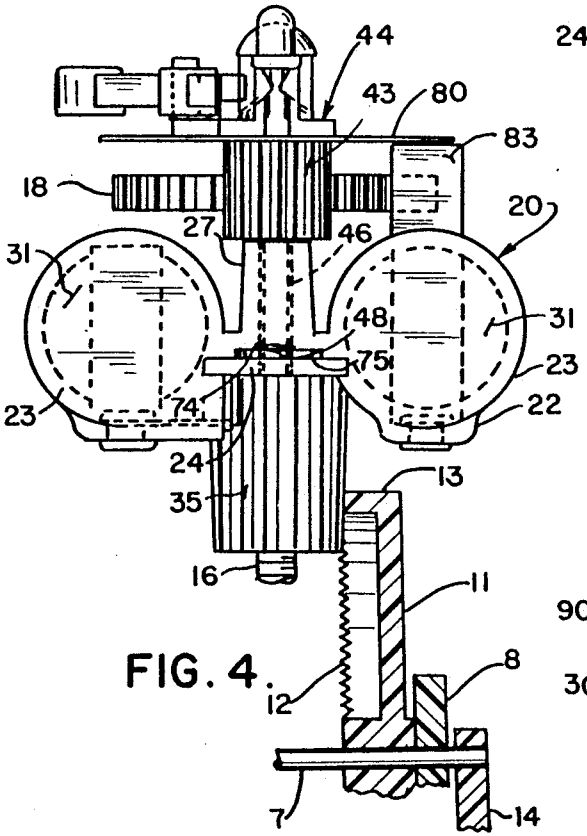
FIG. 4 is a view in end elevation viewed from right to left of FIGS. 2 and 3.
Figure 5:
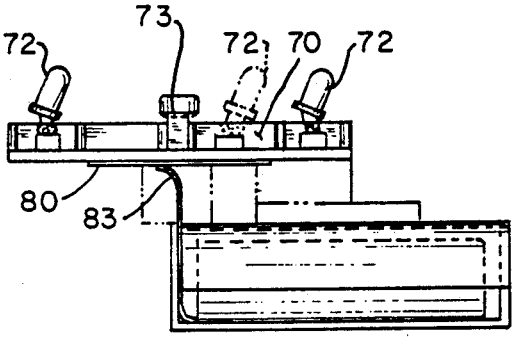
FIG. 5 is a somewhat reduced detail view showing a wiper contact.

Referring now to the drawing, reference numeral 1 indicates a wheeled push toy with one illustrative embodiment of light display of this invention. The toy has a housing 2 made up of a chassis 3 and a cover 4. A handle 5 is demountably mounted on the chassis. The toy has wheels 6, fixedly mounted on an axle 7. In this embodiment, a cam 8 is mounted on the axle to operate a crank 9, to move feet 10 in response to the rotation of the axle. As shown particularly in FIG. 4, a gear wheel 11 is also mounted on the axle 7. The gear wheel 11 has teeth 12 formed in an edge of an annular flange 13. The chassis has an upstanding stanchion 14 carrying a post 15 in which a shaft 16 is fixedly mounted. The lower end of the shaft 16 is threaded and is screwed into a tapped hole in the post 15. The shaft 16 has at its upper end a hexagonal head 17, that fits into a complementarily shaped seat in a fixed gear 18.

A support platform assembly 20 made of an electrically insulative material such as plastic, is rotatably mounted on the shaft 16 between the lower side of the gear 18 and the upper surface of the post 15. The support assembly includes a base 22, with battery cradles 23 joined by an intermediate web 24 from which a shaft boss 25, an idler gear boss 26 and a light bracket boss 27 project upwardly. The base has end walls 30 and 31. A support platform gear 35 is integral at its upper end with the underside of the web 4 of the base 22, and projects downwardly from the base to the upper surface of the post 15. The shaft boss 25 and support platform gear 35 have an axially aligned passage 36 through them, through which the shaft 16 extends, to journal the support platform assembly on the shaft 16. An idler gear 40 is journaled on an idler gear shaft 41 projecting upwardly from the idler gear boss 26. The idler gear 40 has teeth that mesh with the teeth of the fixed gear 18. The idler gear teeth also mesh with teeth on a light bracket gear 43, journaled for rotation on a light bracket center pin 46 made of an electrically conductive material. The light bracket center pin 46 has a threaded lower end screwed into an internally threaded passage through the light bracket boss 27, and projects into a slot 75 between the light bracket boss 27 and a portion of the web 24.

The light bracket gear 43 forms a part of a light bracket assembly 44. The light bracket assembly 44 includes, besides the center pin, a table 54 made of electrically insulative material, with an expanded center section 55 from which arms 49 and 50 extend diametrically with respect to the center pin 46. A light bracket assembly tube 45 is integral with an upper surface of the enlarged area 55. The tube 45 has a passage extending through it and through the table and gear 43, through which the center pin 46 extends.

Figure 2:
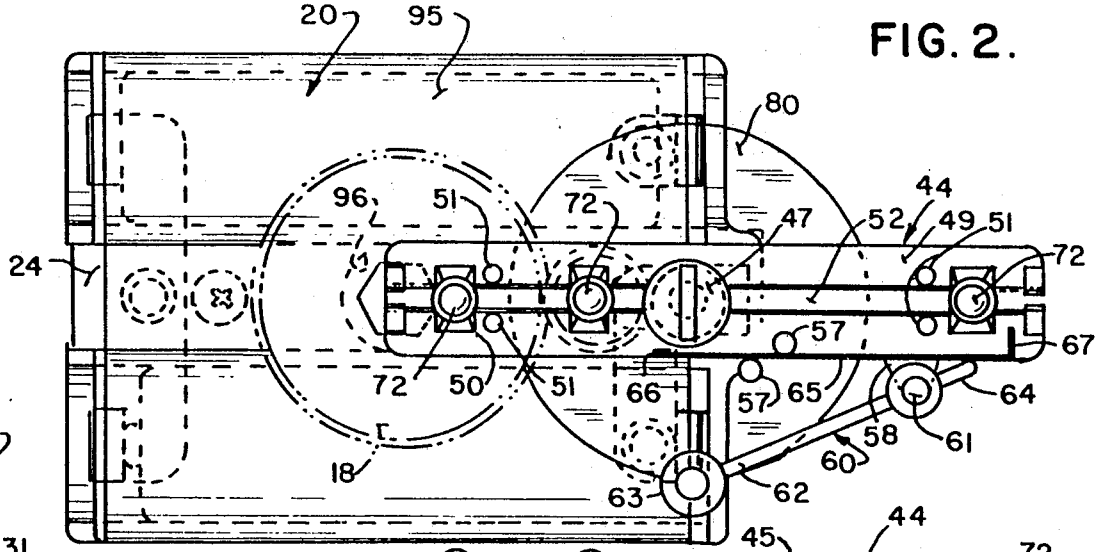
FIG. 2 is an enlarged top plan view of the apparatus shown in FIG. 1.
Figure 3:
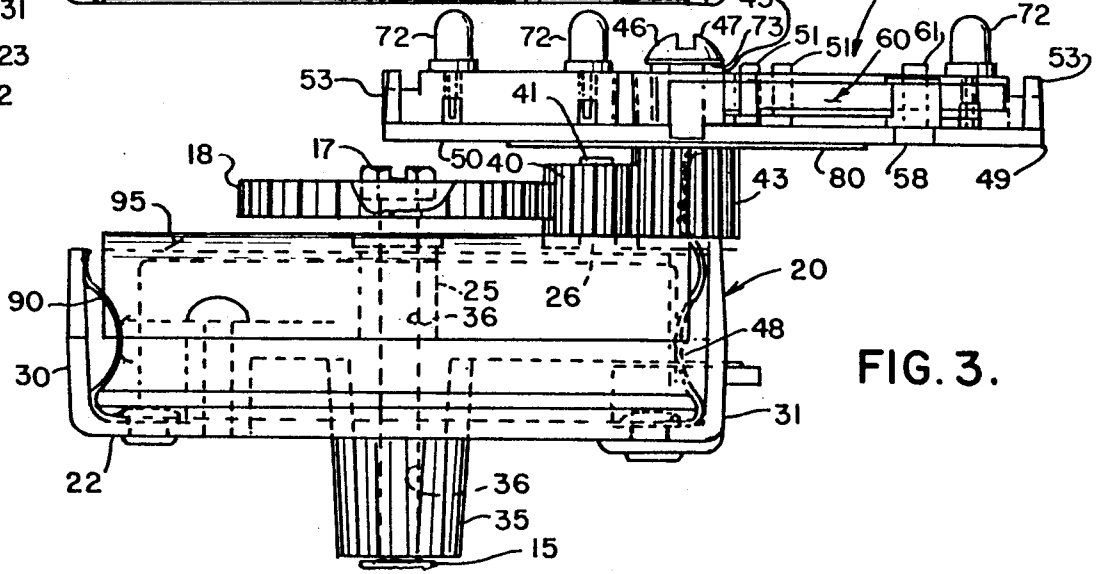
FIG. 3 is a view in side elevation of the apparatus shown in FIG. 2.
Figure 6:
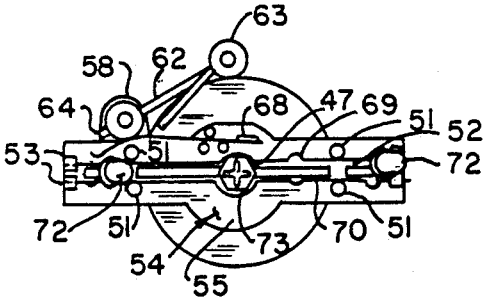
FIG. 6 is a top plan view of a portion of the apparatus showing a slightly different configuration of centrifugal switch.
Figure 7:
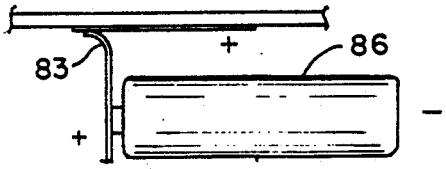
FIG. 7 is a fragmentary view in side elevation showing a detail of battery and wiper contact.
Figure 8:
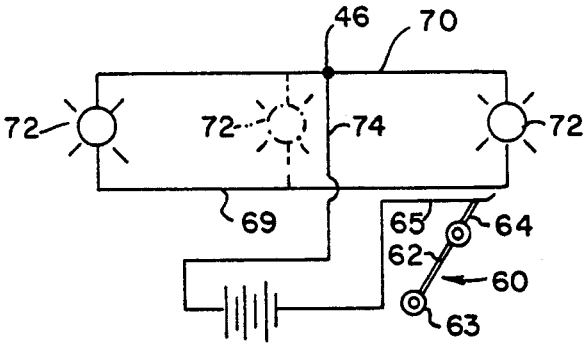
FIG. 8 is a simplified diagrammatic view of the circuit of the illustrative embodiment shown and described.

Locating and retaining pins 51, integral with the upper surface of the arms 49 and 50, flank a central divider 52, also integral with the upper surface of the table. The divider 52 ends short of the outer ends of the arms, to leave a space between the ends of the divider and facing inverted L-shaped retainers 53. Contact arm pins 57 are integral with the table, offset from one another and from one side of the divider 52, as shown particularly in FIGS. 2, 3 and 6. An actuator support platform 58 projects from one edge of the arm 49. A centrifugal actuator 60 is mounted on a post 61 projecting upwardly from the platform 58, for rotation about the post. The actuator has a swing arm 62 with a weight 63 at its outer end, and an actuating lever 64, all integral with a knuckle journaled on the pin 61, between the swing arm 62 and the actuating lever 64. The actuating lever 64 bears at its end upon a contact arm 65. The contact arm 65 has a terminal end 66 and a contact end 67. The contact arm 65 is flexible, and is held in position by the pins 57, as shown in FIGS. 2 and 6. An electrical conductor electrically connected to the terminal end 66, passes through a hole 68 in the enlarged area 55 of the table 54, and is electrically connected to an electrically conductive disc 80, electrically insulated from the center pin 46. The contact end 67 of the contact arm, makes and breaks contact with an electrically conductive ribbon 69, which is held in position along the dividers 52 by pins 51, and is caged at its ends by the retainers 53. On the other side of the divider 52, similarly positioned and caged, is a ground conductive ribbon 70. Lamps, in the illustrative embodiment shown, light emitting diodes (L.E.D.'s), are connected electrically and mechanically to the two strips 69 and 70. Both of the ribbons 69 and 70 are formed to accommodate and conform to a portion of the light bracket assembly tube 45, as shown particularly in FIG. 6, and the ground ribbon 70 has, in this embodiment, integrally with it, a contact collar 73?, bent to serve as a sort of belleville or wafer washer, to give good electrical contact with the underside of the head 47 of the light bracket center pin, which is electrically conductive. The lower end of the center pin 46 is in electrical and mechanical contact with a terminal end of a ground conductor 74 which is resiliently biased into contact with the negative end of a battery 87. A bridging conductor 90 engages the positive end of the battery 87 and a negative end of a battery 86, the positive end of which is electrically connected to a wiper contact 83 that is resiliently biased into electrical and mechanical contact with an under surface of the conductive disc 80.

The two batteries, which lie in the cradles 23, are covered by a battery cover 95. The battery cover has two sections shaped complimentarily to the cradles 23, joined by a web which is cut away as indicated at 96 in FIG. 2, to accommodate the various posts projecting upwardly from the base web 24.

Figure 9:
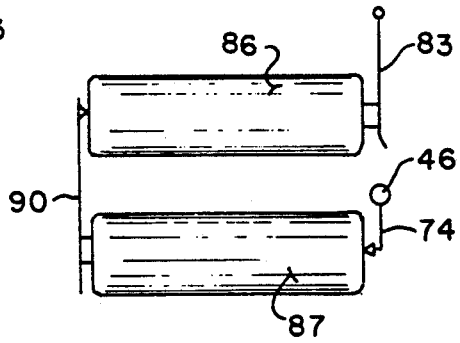
FIG. 9 is a somewhat schematic view of the battery circuit.

In operation, when the toy is pushed with the wheels in frictional contact with a surface, the gear 11 is rotated, causing the gear 35 to rotate, rotating the support platform 20 about the shaft 16 and fixed gear 18. The meshing of the teeth of the gear 18 with the idler gear 40, rotates the idler gear 40. The meshing of the teeth of the idler gear 40 and the light bracket gear 43 causes the gear 43, hence the light bracket 44, to rotate. The rotation of the light bracket assembly 44 causes the weight 63 to move outward in response to centrifugal force, rotating the swing arm 62 outwardly and the actuating lever 64 inwardly to force the contact end 67 of the contact arm 65, against the bias of the resilience of the contact arm, from its normally open position to a position at which it makes electrical contact with the conductive ribbon 69. When it does so, current from the positive terminal of the battery 86 flows, through the wiper contact 83, and the conductive disc 80, through the conductor to the terminal end of the contact arm, through the ribbon 69, to energize the lamps 72, the circuit being completed through the ground ribbon 70, collar 73, center pin 46, and conductor 74, to the ground or negative side of the battery 87, the batteries 87 and 86 being arranged in series, as shown particularly in FIG. 9. When rotation of the light bracket assembly is stopped, or falls below a certain minimum rate of rotation, the bias of the contact arm 65 moves the contact end 67 away from the ribbon 69, rotating the centrifugal actuator arm to the position shown in FIG. 2.

Figure 1:
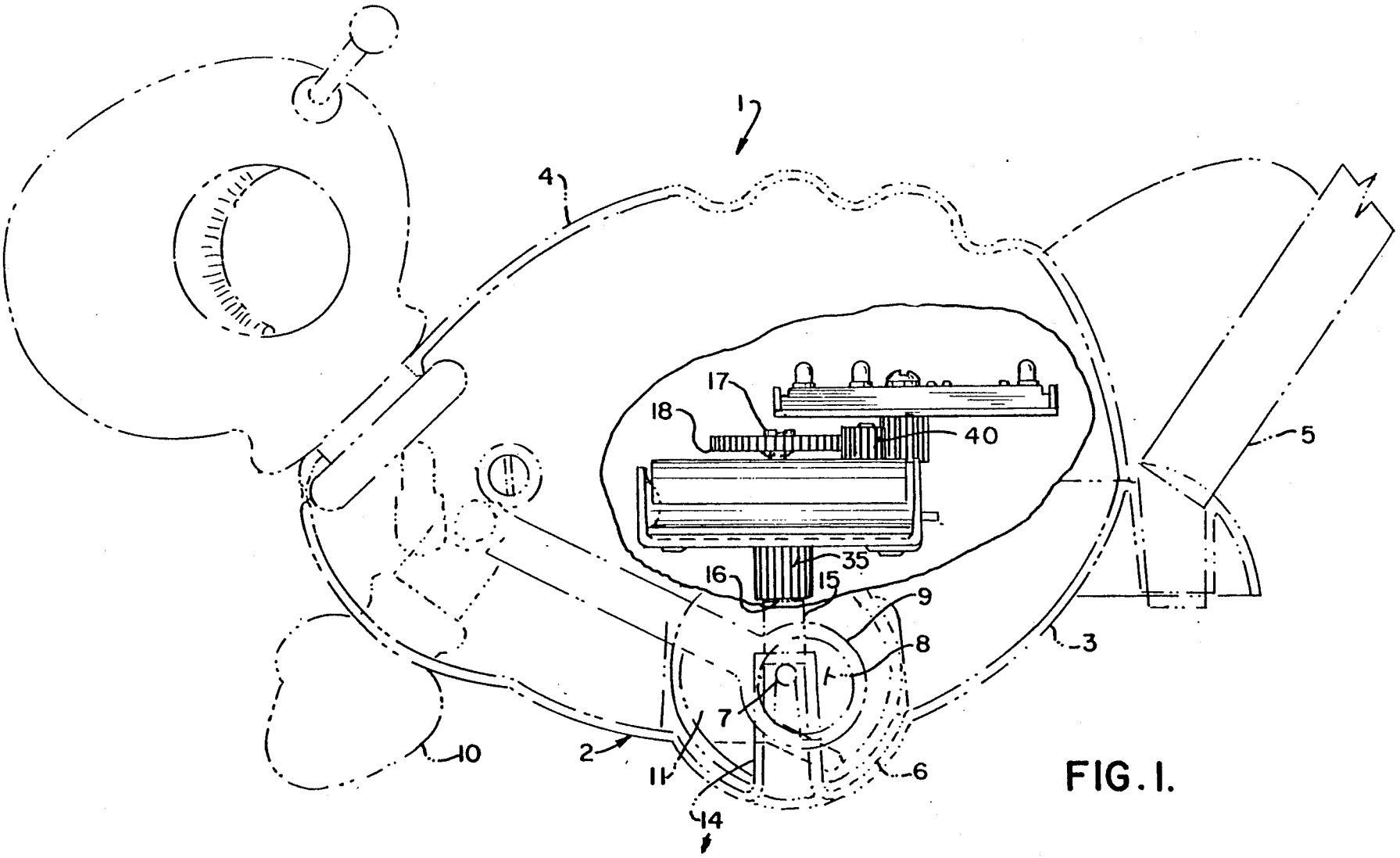
FIG. 1 is a view in side elevation, with one illustrative form of wheeled toy shown in phantom lines, cut away to show one illustrative embodiment of light display apparatus of this invention.

As will be appreciated from FIG. 1, the rotation of the wheels 6, hence the axle 7, also rotates the cam 8, which, acting through the crank 9, causes the feet 10 to move back and forth about a pivot axis of a bar on which they are mounted.

FIGS. 10–14 show a second embodiment of the light display apparatus which may be used with the toy 1. This embodiment includes a support assembly 120 rotatably mounted on shaft 16 in the same manner as support assembly 20. Like assembly 20, assembly 120 includes a shaft boss 25', an idler gear boss 26' a light bracket boss 27', and a support platform gear 35' integral with assembly 120 beneath shaft boss 25'. Bosses 25' and 26' extend upwardly from an elongate base 122 and are joined by a narrow web 128. A wide web 129, to which boss 27' is connected, extends outwardly from boss 26'. An axial passage 36' extends through boss 25' and gear 35' through which shaft 16 extends to journal the support platform assembly on shaft 16.

An idler gear 40' is journaled on an idler gear shaft 41' extending upwardly from boss 26', and meshes with teeth of fixed gear 18 in the same manner as idler gear 40. As in the previous embodiment, the idler gear teeth mesh with the teeth of a light bracket gear 43. The light bracket gear 43' is integral with the underside of a light bracket assembly 144. Light bracket assembly 144 and gear 43' are journaled for rotation on a center pin 146 which is threaded into an internally threaded passage in light bracket boss 27'.

Figure 11:
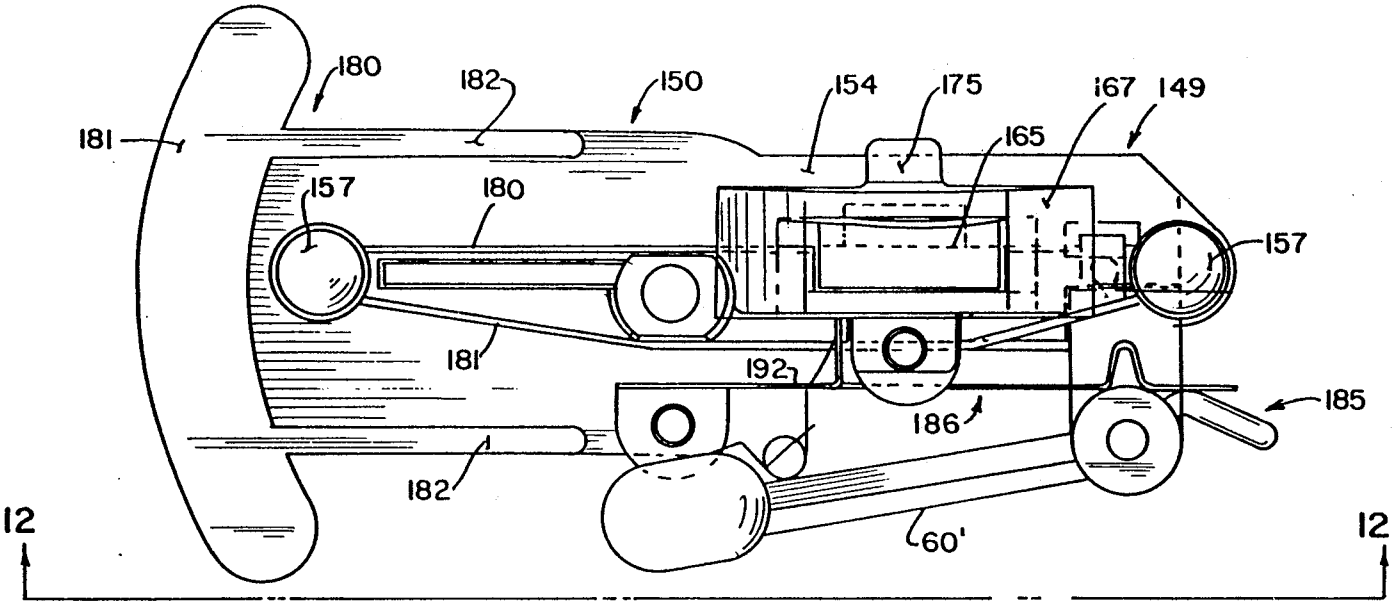
FIG. 11 is a top plan view of a light bracket assembly of the embodiment of FIG. 10.
Figure 12:
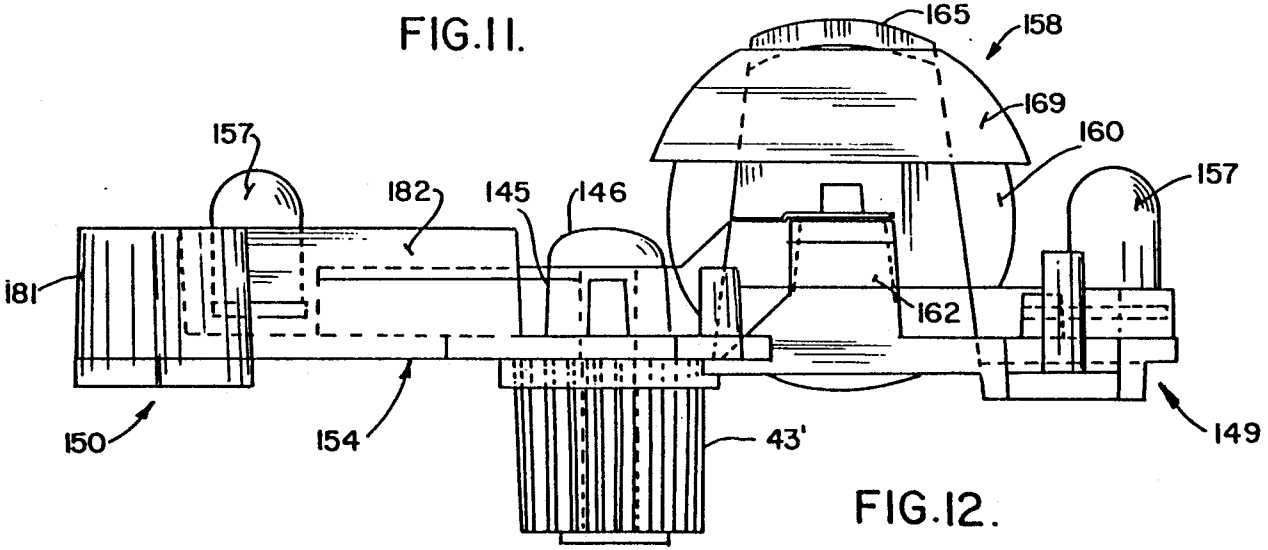
FIG. 12 is a front elevational view taken along line 12—12 of FIG. 11 with a switch arm and switch contact removed.
Figure 10:
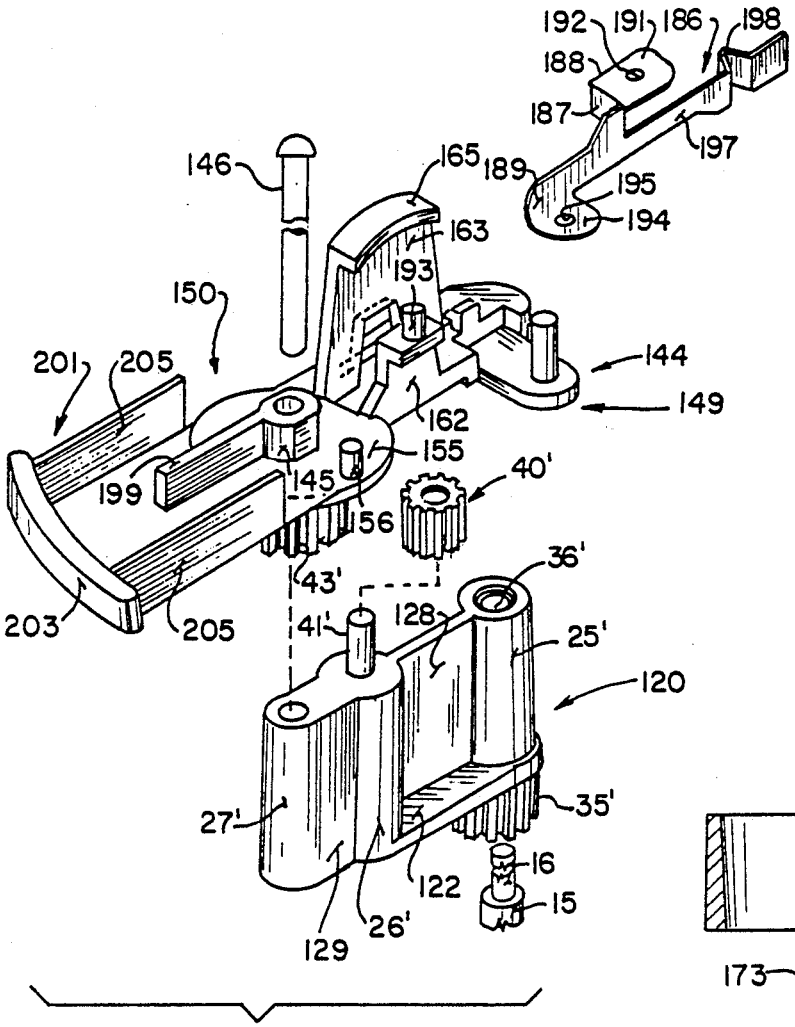
FIG. 10 is an exploded view of a second illustrative embodiment of light display apparatus of the invention.
Figure 13:
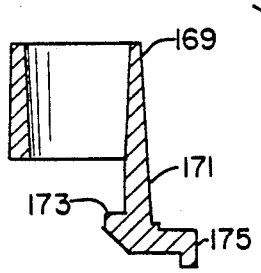
FIG. 13 is an exploded cross-sectional view of battery retaining means for the embodiment of FIG. 10.
Figure 13:
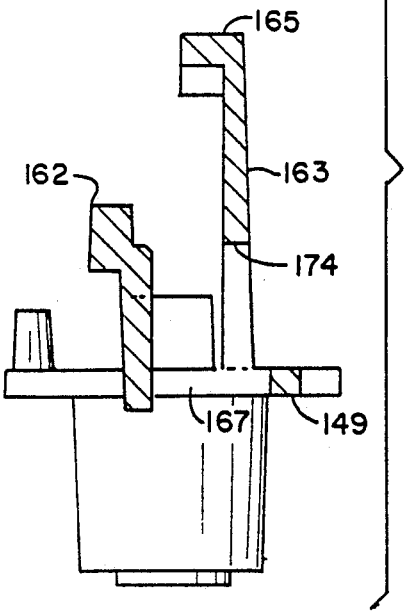
Figure 14:
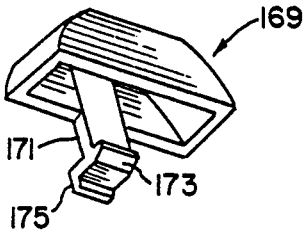
FIG. 14 is a perspective view of a cap of the battery retaining means of FIG. 13.

As seen in FIGS. 11 and 12, light bracket assembly 144 includes a table 154 having a pair of arms 149 and 150 extending diametrically from a circular center 155 and having lights 157 at their ends. Pin 146 extends through a passage in a hub 145 integral with and in the middle of center 155. Hub 145 is flattened on opposite sides, as seen in FIGS. 10 and 11. Center 155 includes a retaining pin 156 near its periphery.

Arm 149 is approximately one-half the width of center 155. Arm !49 includes an upwardly extending bracket assembly 158 for holding a flat lithium battery 160. Bracket assembly 158 includes a pair of "L" shaped walls 162 and 163 in spaced relation, battery 160 fitting between the walls. Wall 162, positioned in front of battery 160, extends half-way up battery 160. Wall 163 extends the full height of battery 160 and has a top 165 shaped to conform to the curved edge of the battery 167. Battery 160 fits into a slot 167 between walls 162 and 163 and extends slightly beneath arm 149. A cap 169 fits over wall 163 and battery 160 to secure the battery in bracket 158. Cap 169 includes a flexible arm 171 having a finger 173 which cooperates with a slot 174 in wall 163 to hold cap 169 on wall 163. A second finger 175 enables a user to pry finger 173 out of slot 174 to remove cap 169 when battery 160 has to be replaced.

Battery 160 supplies electricity to lights 157 through a pair of electrically conductive ribbons 180, 181 and a switch contact assembly 185. Ribbon 180 is positioned between wall 163 and battery 160 to be held in electrical contact with the negative pole of battery 160. A switch assembly 185 includes a contact assembly 186 and a centrifugal actuator 60' identical to actuator 60. Contact assembly 186 includes a body 187 having a pair of legs 188, 189 extending in opposite directions. Leg 188 includes a top plate 191 having a hole 192 which cooperates with a pin 193 on a ledge of wall 162. Leg 189 includes a plate 194, bent from a lower edge of the leg 189 and having a hole 195 which cooperates with center pin 146. Pin 146 is headed, and pin 193 may be headed over to hold leg 188 in contact with the positive pole of battery 160, leg 188 being a terminal end of contact assembly 186.

A flexible contact arm 197 having a contact end 198 extends from body 187 in a direction opposite that of leg 189. Actuator 60' bears upon the end of contact arm 197 to bring contact end 198 into contact with ribbon 181 in the same manner as actuator 60 bears upon ribbon 69. The electrical circuit in this embodiment thus consists of battery 160, ribbon 180, light 157, ribbon 181, contact arm 197, contact body 187, and contact leg 188, which is in contact with the positive side of battery 160, to complete the circuit through the lamps 156.

Ribbons 180 and 181 are separated by battery 160 and post 162 on arm 149. Arm 150 includes a divider 199 to separate the ribbons. The leads of the L.E.D.s can be utilized to serve as the ribbons 180 and 181. Arm 150 further includes a counterweight assembly 201 to offset the weight of the battery 160 and contact assembly 185 of arm 149 so that the two arms carry approximately the same weight. Counterweight assembly 201 includes a curved head 203 and a pair of arms 205 extending along the edges of arm 150 to form a "U".

This second embodiment operates in the same manner as the first embodiment. However, because the electrical circuit is completely carried by the light bracket assembly, support assembly 120 is smaller and the need for disc 80 and wiper contact 83 is obviated, making the circuit more reliable. Further, because a lithium battery is used, the whole apparatus is lighter in weight.

Numerous variations in the construction of the light display of this invention, within the scope of the appended claims, will occur to those skilled in the art in the light of the foregoing disclosure. Merely by way of example, although a single light bracket assembly has been shown, it can readily be appreciated that another could be mounted at the opposite end of the support platform, with suitable electrical contacts from the respective negative and positive terminals of the batteries. Although three lamps 72 are shown in the illustrative embodiment, it is evident that almost any number of lamps can be arranged either symmetrically or asymmetrically along the ribbons 69 and 70 or 180 and 181. If more than one light bracket assembly is used, and three or four could be employed by simple modification of the support platform, the arms of the different brackets can be made short enough to clear one another, or, because the relative positions of the arms of the different brackets are fixed by the meshing of the gears, they can be arranged to be sufficiently out of phase to accommodate one another much in the manner of the rotors of a rotary compressor, for example. More than two arms can be arranged symmetrically about the expanded area of the table. Other forms of centrifugal switch can be used, as for example, balls on an inclined conductive channel, inclined upwardly outwardly, the balls, under the influence of centrifugal force, rolling to the outer end of the channel, bridging a space to complete a circuit, but such a system has the disadvantage of being properly operable only when the axis of rotation is vertical. The embodiment described has the virtue that it operates in whatever orientation the device may have, provided that the weight 63 is not, of itself, sufficient to cause the contact arm to move to circuit making position. The mechanical actuating arrangement shown and described in a simple and economical way of operating the device. However the device can also be driven by miniature electric motors, one driving the support platform, and others, the light brackets, with suitable commutation. The device can be mounted on a stand or wand, operated by a crank or flywheel, or by twirling the wand, and the ribbons arranged to permit positioning of lights and their insertion at the whim of the user, or the mounting of additional light bracket assemblies. These are merely illustrative.

Having thus described the invention, what is claimed and desired to be secured by Letters Patent is:

1. A light display apparatus comprising a shaft with an axis; support platform means rotatably mounted on said shaft; light bracket means mounted on said support platform means at a position offset from said shaft axis, for rotation about a light bracket means axis; electric light means mounted on said light bracket means at a position offset from said bracket means axis; means for rotating said support platform means; means for rotating said light bracket means with respect to said support platform means; a source of current supplying electrical power to said light means through an electrical circuit, and centrifugal switch means for opening and closing said circuit, said switch means being responsive to the rotation of said apparatus, said light means including at least one electric lamp, said centrifugal switch means comprising an elongated lever pivoted closer to one end than to another to define a long end and a short end, said long end being offset from a radial line from said shaft axis and said short end bearing on a normally open-biased switch contact and being arranged to close said circuit to connect said power source to said lamp when the speed of revolution of said bracket reaches a predetermined amount.

2. The apparatus of claim 1, wherein said electrical circuit includes a battery, said battery having positive and negative poles, two conductor means extending from said light means, and a switch contact, wherein one of said conductor means is electrically connected to one pole of said battery and said switch contact is electrically connected to the other of said poles.

3. The apparatus of claim 1 including a multiplicity of lamps.

4. The apparatus of claim 1 wherein the said light means are light emitting diodes.

5. The apparatus of claim 1 wherein said power source is at least one battery and said battery is carried by said support platform means.

6. The apparatus of claim 1 wherein said source of current is a battery and the light bracket means includes a conductive disc electrically connected to a contact arm of said centrifugal switch means and electrically connected by means of a wiper contact, with said battery.

7. In a light display apparatus comprising a shaft with an axis; support platform means rotatably mounted on said shaft; light bracket means mounted on said support platform means at a position offset from said shaft axis, for rotation about a bracket means axis; electric light means mounted on said light bracket means at a position offset from said bracket means axis; means for rotating said support platform means; means for rotating said light bracket means with respect to said support platform means; a source of current supplying electrical power to said light means through an electrical circuit, and centrifugal switch means for opening and closing said circuit, said switch means being responsive to the rotation of said bracket, the improvement comprising said source of current being a disc type battery mounted on said light bracket means; said electric circuit including a pair of electrically conductive ribbons electrically connected to said electric light means, one of said ribbons being electrically connected to one side of said battery, and said centrifugal switch means comprising a flexible arm electrically connected to the other side of said battery and normally biased out of contact with the other of said ribbons and an eccentrically pivoted centrifugal actuator mounted on said bracket and constructed to move said arm against said bias into contact with said other ribbon when said bracket is rotated at or above a predetermined speed.

8. The apparatus of claim 7, wherein the battery is offset from said light bracket means axis, said light bracket means including counterweight means at a position offset from said light bracket means axis and opposite said battery.

9. The apparatus of claim 7, wherein said electrical circuit and centrifugal switch are carried entirely by said light bracket means.

10. The improvement of claim 7 wherein said source of current is a battery having two sides, and said battery is mounted between two walls having parallel surfaces, on one of which walls a body integral with said centrifugal switch flexible arm is mounted to engage one side of said battery, and between the other of said walls and the other side of said battery the said one ribbon extends to make contact with said other side of said battery.

11. The improvement of claim 10 wherein one of said walls has a slot in it, and a cap is provided, caging a part of said battery and a part of said one wall, said cage having a finger projecting into said slot to hold said cap, hence said battery, in position.

12. The improvement of claim 7 wherein said electric light means comprise two light emitting diodes, and said ribbons are leads extending from said diodes toward one another.

13. In a light display apparatus comprising a shaft with an axis; support platform means rotatably mounted on said shaft; light bracket means mounted on said support platform means at a position offset from said shaft axis, for rotation about a bracket means axis; electric light means mounted on said light bracket means at a position offset from said bracket means axis; means for rotating said support platform means; means for rotating said light bracket means with respect to said support platform means; a source of current supplying electrical power to said light means through an electrical circuit, and centrifugal switch means for opening and closing said circuit, said switch means being responsive to the rotation of said bracket, the improvement comprising said source of current being a battery, said battery, centrifugal switch means and all of said electrical circuit being mounted on said light bracket means.

14. A wheeled toy adapted to be operated by a child, comprising a chassis and a translucent cover, an axle, rotatably journaled in said chassis, wheels mounted at opposite ends of said axle outboard of said chassis, a gear fixedly mounted on said axle within said chassis, a shaft carried by said chassis and extending perpendicularly to said axle, a gear fixedly mounted on the upper end of said shaft, a support platform assembly rotatably mounted on said shaft below said fixed gear, said support platform assembly having a base including battery-receiving cradles and an intermediate web between said cradles, a support platform gear connected to and depending from said web, and mounted on and coaxial with said shaft, said platform gear meshing with said axle gear to cause said support platform assembly to rotate in response to rotation of the axle gear; an idler gear mounted for rotation on an idler gear shaft carried by said web and meshing with the said shaft gear, a light bracket gear meshing with said idler gear, a light bracket assembly fixedly connected to said light bracket gear, said light bracket assembly including an electrically conductive center pin on which said light bracket gear and light bracket assembly are rotatably journaled, a table with an enlarged section and outwardly extending arms, an electrically conductive disc positioned between said bracket gear and said table, electrically conductive ribbons mounted on an upper surface of the table on either side of an insulative divider, lamp means electrically connected to said ribbons, a centrifugal switch assembly including a centrifugal actuator hingedly mounted on one of said table arms, said actuator having a swing arm with a weight at its outer end, and a relatively short actuating lever, a resilient contact arm having a terminal end and a contact end, mounted on said table and biased to a position at which it is out of contact with a ribbon immediately adjacent it, but adapted to be moved by outward swinging of the swing arm of the centrifugal actuator and inward movement of the actuating lever to make electrical contact with said ribbon, said contact arm having a terminal end electrically connected to said conductive disc, the other of said ribbons having resilient means in sliding electrical contact with said conductive light bracket center pin, a lower end of said light bracket center pin being electrically connected to a conductor electrically connected to one side of batteries mounted in said cradles, and a wiper contact in electrical contact with the said conductive disc and with an electrically opposite side of said batteries.

15. A wheeled toy adapted to be operated by a child, comprising a chassis and a translucent cover, an axle, rotatably journaled in said chassis, wheels mounted at opposite ends of said axle outboard of said chassis, a gear fixedly mounted on said axle within said chassis, a shaft carried by said chassis and extending perpendicularly to said axle, a gear fixedly mounted on the upper end of said shaft, a support platform assembly rotatably mounted on said shaft below said fixed gear, said support platform assembly having a base including a support platform gear connected to and depending from said base, and mounted on and coaxial with said shaft, said platform gear meshing with said axle gear to cause said support platform assembly to rotate in response to rotation of the axle gear; an idler gear mounted for rotation on an idler gear shaft and meshing with the said shaft gear, a light bracket gear meshing with said idler gear, a light bracket assembly fixedly connected to said light bracket gear, said light bracket assembly including a center pin on which said light bracket gear and light bracket assembly are rotatably journaled, a table with a center section and outwardly extending arms, a battery mounted on one of said arms, electrically conductive ribbons mounted on an upper surface of the table, one of which is electrically connected to one side of said battery, lamp means electrically connected to said ribbons, a centrifugal switch assembly including a centrifugal actuator hingedly mounted on said one of said table arms, said actuator having a swing arm with a weight at its outer end, and a relatively short actuating lever, a resilient contact arm having a terminal end and a contact end, mounted on said table and biased to a position at which it is out of contact with another ribbon immediately adjacent it, but adapted to be moved by outward swinging of the swing arm of the centrifugal actuator and inward movement of the actuating lever to make electrical contact with said other ribbon, said contact arm having a terminal end electrically connected to said battery, said battery and all of said electrical circuit being mounted on said light bracket means.

16. The wheeled toy of claim 15 wherein said table arm not carrying said battery includes a counterweight.

* * * * *